US006105279A

United States Patent [19]

Bouchoms

[11] Patent Number: 6,105,279

[45] Date of Patent: Aug. 22, 2000

[54] SHOE AND SHOE COMPRISING THIS SOLE

[75] Inventor: Jean Francois Bouchoms, Guillaume Kroll, Luxembourg

[73] Assignee: Prodomo, S.A., Luxembourg

[21] Appl. No.: 09/101,222

[22] PCT Filed: Apr. 30, 1997

[86] PCT No.: PCT/EP97/02228

§ 371 Date: Mar. 22, 1999

§ 102(e) Date: Mar. 22, 1999

[87] PCT Pub. No.: WO98/19572

PCT Pub. Date: May 14, 1998

[30] Foreign Application Priority Data

Nov. 4, 1996 [EP] European Pat. Off. ..... 96117656

[51] Int. Cl.[7] ..... A43B 13/00; A43B 13/04

[52] U.S. Cl. ..... 36/25 R; 36/32 R

[58] Field of Search ..... 36/25 R, 30 R, 36/32 R, 28, 59 C, 12

[56] References Cited

U.S. PATENT DOCUMENTS

| | | | |
|---|---|---|---|
| 2,981,011 | 4/1961 | Lombardo | 36/25 R |
| 4,041,618 | 8/1977 | Famolare, Jr. | 36/25 R |
| 4,045,888 | 9/1977 | Oxenberg | 36/32 R X |
| 4,130,947 | 12/1978 | Denu | 36/30 R |
| 4,309,831 | 1/1982 | Pritt | 36/3 R |
| 4,498,251 | 2/1985 | Shin | 36/30 B |
| 4,663,865 | 5/1987 | Telecemian | 36/30 R X |
| 4,845,863 | 7/1989 | Yung-Mao | 36/28 X |
| 5,839,208 | 11/1998 | Huang | 36/28 |

FOREIGN PATENT DOCUMENTS

| | | | |
|---|---|---|---|
| 0 185 781 | 12/1984 | European Pat. Off. | A43B 13/18 |
| 0 377 781 | 7/1989 | European Pat. Off. | A43B 13/22 |
| 90 14 122 U | 1/1991 | Germany | A43B 13/18 |
| PCT/US82/00417 | 4/1982 | WIPO | A43B 13/18 |

*Primary Examiner*—B. Dayoan
*Attorney, Agent, or Firm*—Gardner, Carton & Douglas

[57] ABSTRACT

A shoe made of flexible material having an outer sole. The outsole having an inner surface, an underside, a longitudinal axis, a heel zone, a toe zone, a ball between the toe and heel zones, and an edge surrounding the sole surface. The inner surface includes inner projecting elements wherein inner projecting elements form a substantially rectangular grid. The underside includes outer projecting elements wherein the outer projecting elements are interrupted webs that extend substantially transversely to the longitudinal axis, at least one longitudinal rib on the underside parallel to the edge on the sole underside, and a sickle-shaped reinforcement zone on the inner surface filling a portion of the rectangular grid between the ball of the foot zone and the heel zone.

23 Claims, 3 Drawing Sheets

SHOE AND SHOE COMPRISING THIS SOLE

FIELD OF INVENTION

This invention relates to a shoe sole or outsole according to the preamble to claim 1.

The invention also relates to a shoe, according to the preamble of claim 12, having such a sole.

SCOPE OF THE PRIOR ART

The design of shoe soles or outsoles was and is a problem with which man long has been and still is concerned. In the area of modern shoe manufacture a trend has developed in which prefabricated soles are used which, after manufacture, are suitable for combining with the other elements of a shoe (insole, upper, etc.) without any additional processing steps being necessary.

DE GM 90 14 122.9 discloses a prefabricated sole for shoes comprising a sole surface wherein projecting elements in the form of webs are disposed on the inside of the sole facing the insole and extend transversely of the longitudinal direction (longitudinal axis of the sole). In the heel zone and partly in the intermediate zone between the heel zone and the ball of the foot zone, a longitudinal web extending in the direction of the longitudinal axis is provided in the area of the longitudinal centre-line of the sole in those zones. The transverse webs extend from the tip of the sole to the end zone of the heel zone in parallel relationship and are defined by an edge at the respective ends.

DE OS 25 30 403 discloses a sole for high-heeled shoes wherein elements in the form of a rectangular grid are provided which project inwards from the sole surface to the insole, the web-like edges of the grid extending diagonally, i.e. including an angle of about 45° to the sole longitudinal axis.

EP 185 781 discloses a shoe sole of plastics or rubber wherein a diamond-shaped grid is provided in the heel zone and in the ball of the foot zone, the grid webs extending obliquely to the longitudinal axis of the shoe and being inclined forwardly in order to allow the foot to be resiliently supported and damped during walking.

It has long been known medically that the most natural and healthiest form of walking is barefoot walking. What is involved here is that during walking naturally the foot rolls on the sole from the heel as far as the toes and a specific pressure distribution is obtained at the sole surface of the foot and comprises substantially a linear pressure peak line extending in the longitudinal direction.

However, all soles of the above-cited prior art specifications have the disadvantage that because of the design of the inwardly projecting elements, on the one hand, and the design of the underside of the sole surface, on the other hand, walking complying with the optimal medical requirements is not rendered possible.

SUMMARY OF THE INVENTION

The object of this invention, therefore, is so to improve a shoe sole or outsole of resilient material of the type referred to in the preamble that it is possible for walking in the shoe to correspond substantially to barefoot walking.

The invention also relates to a shoe having such a sole.

To this end, according to the invention, the elements projecting at the underside are interrupted webs which extend substantially transversely of the sole longitudinal direction or longitudinal axis, at least one longitudinal rib is provided parallel to the sole outer contour on the sole underside at least along the outside of the sole and has a distance from the sole outer contour distinctly less than half the sole width in the heel zone, and a sickle-shaped reinforcement zone filling the grid is provided between the ball of the foot zone and the heel zone and extends from the sole inside in the direction of the longitudinal axis of the sole.

This design gives a sole rolling behaviour substantially corresponding to a natural rolling behaviour of the human foot.

Advantageously, this sole provides a very slip-proof configuration which thus serves for all-weather use including use in snow or on a non-consolidated subsoil.

Advantageous embodiments of the shoe sole or outsole according to the invention will be apparent from the subclaims.

By constructing the projecting elements integrally with the sole surface the sole consists of just one part, this giving advantages in respect of processing. Other steps to connect with the other components of a shoe are necessary only to a considerably reduced degree, and in particular there is no need for the sole to be glued to the other components of the shoe.

The same applies to the at least one longitudinal rib.

Since the one longitudinal rib in the front end zone or toe zone of the sole surface follows the outer contour of the sole surface at a substantially equal distance therefrom, while extending along the inside of the shoe sole in that zone, the good rolling behaviour is enhanced and, in particular, the transmission of the foot force on push-off for the next step is advantageously assisted.

The construction of a flat projecting element in the heel end zone increases the damping action in the sole when it meets the ground at the start of the rolling movement of the sole.

The same applies to the element projecting in the form of a strip at the front end zone of the sole.

By constructing a second longitudinal rib parallel to the first, the support function and stabilisation of the shoe sole is advantageously increased, thus avoiding any twisting of the sole, which is appropriately adequately elastic for the rolling process.

Since in the region between the heel zone and the ball of the foot zone there is in each case an edge zone offset at the inside and at the outside of the sole contour in the direction of the insole and projecting beyond the substantially flat inner surface of the sole surface, the sole contact surface on the ground is reduced in this zone, thus further improving the rolling process.

Advantageously, the width of an edge zone is about 10 to 20% of the total width in this zone.

If the elements projecting in the form of a grid have a different height adapted to the form of the human foot sole, a very good fit is obtained which follows the anatomical configuration of the foot. As a result, corresponding force and pressure transmission zones are avoided and the effect of barefoot walking is further assisted.

In these conditions, the elements projecting furthest upwards are located at the boundary zones to the outer edge of the sole, so that the sole allows an appropriate lateral guidance with respect to the foot.

The invention also relates to a shoe having an upper consisting of vegetable-tanned leather, which is connected to an insole of natural material, such as leather, cork, etc., and is fixed to an outsole of natural latex, the upper having an outwardly projecting edge which is connected to the insole at the edge thereof. A lateral bead is formed on the outer wall of the sole and defines an inner fillet, and the interconnected edges of the upper and the insole are disposed in the fillet, wherein the upper and the insole are fixed to the outsole by means of an outer seam extending through the bead and the edges. The shoe according to the invention is characterised in that it comprises an outsole according to any one of claims 1 to 11.

BRIEF DESCRIPTION OF THE FIGURES

Further details, features and advantages of the present invention will be apparent from the following description with reference to the drawing wherein.

DETAILED DESCRIPTION OF THE PREFERRED EMBODIMENT

Figure 1:
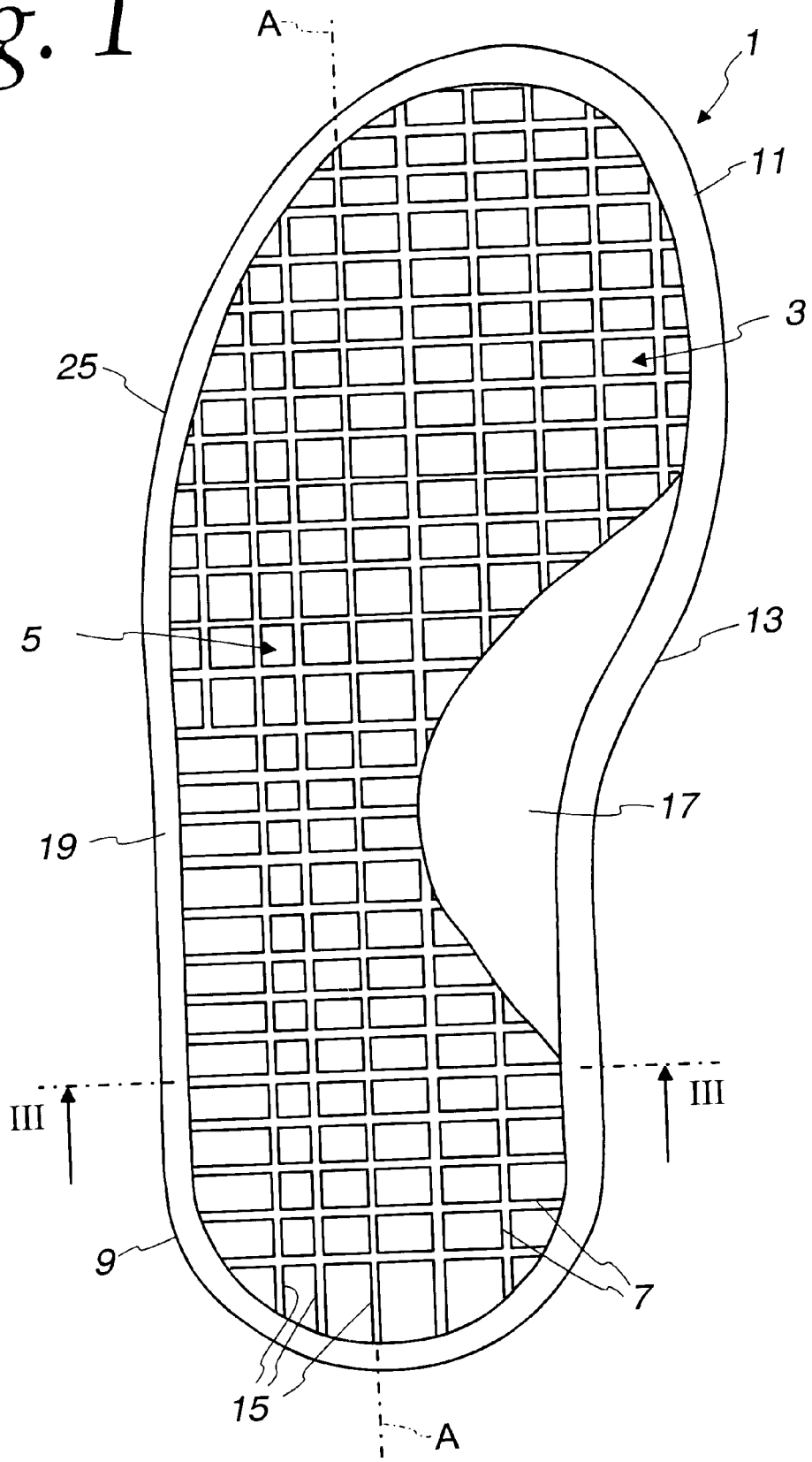
FIG. 1 is a plan view of the inside of an outsole according to the invention.

In the drawings described hereinafter, like parts have like references.

FIG. 1 is a plan view of an outsole 1 according to the invention. FIG. 1 shows the inside 3 of the sole 1 according to the invention, this clearly being the left sole of a corresponding pair.

The sole 1 has a substantially flat inner surface 5, from which elements 7 project in the direction of the insole. The projecting elements 7 are constructed in the form of a rectangular grid.

The sole 1 has a longitudinal axis A, which extends substantially in the middle of the heel zone 9 of the sole 1.

Following the anatomical configuration of the human foot, the foot ball and toe zone 11 is arranged to be offset in the direction of the inside 13 of the sole 1.

The projecting elements 7 are formed from webs which on the one hand extend parallel to one another in the direction of the longitudinal axis A and on the other hand also parallel to one another in a direction towards the longitudinal axis A.

The height of the projecting elements 7 above the sole inner surface 5 varies, the surface contour being formed to correspond substantially to the sole surface of a human foot, in which the minimum height of the projecting elements 7 is in the zone of the ball of the foot and the maximum height in the heel zone 9.

As will also be clear from FIG. 1, the sole 1 according to the invention has five parallel longitudinal webs 15 extending in the heel zone 9.

Of course, the number of longitudinal webs 15 can be selected to vary according to the size of the sole 1, for example the number will be correspondingly less for children's shoe soles.

To support the bed of the human foot, the inside 13 of the sole 1 is formed with a sickle-shaped reinforcement zone 17 which fills the interstices between the projecting elements 7.

The sickle-shaped reinforcement zone 17 extends in the direction of the longitudinal axis A of the sole 1 as will be clearly visible from FIG. 1.

Also, in manner known per se, the sole according to the invention has an edge 19 which extends around the entire sole inner surface 5. The formation of the edge 19 will be described in detail below with reference to FIG. 3.

Figure 2:
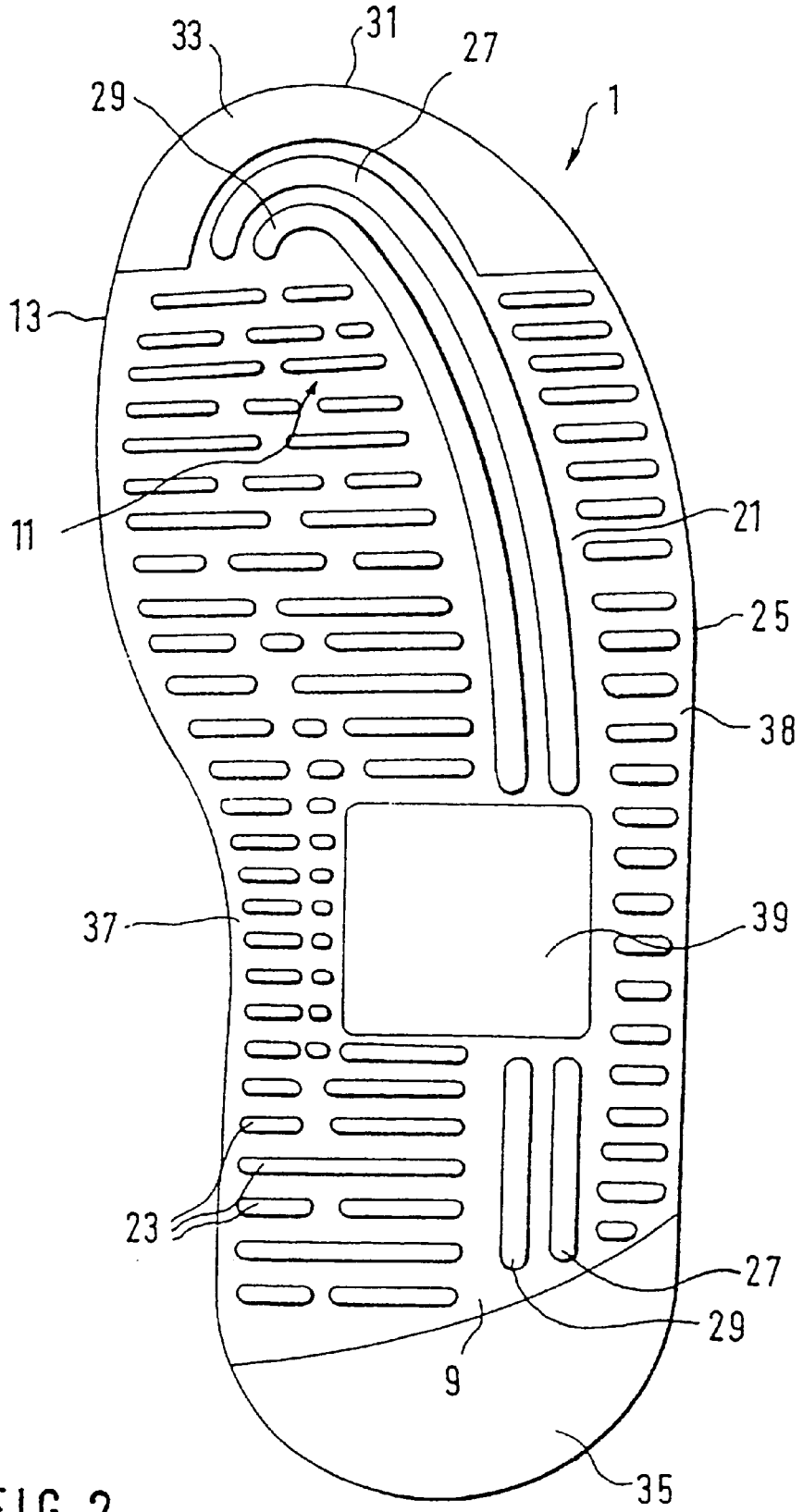
FIG. 2 shows the underside of the sole according to the invention shown in FIG. 1.

FIG. 2 shows the underside 21 of the sole 1.

As will be seen from this Figure, the underside 21 is provided with downwardly projecting elements 23 formed as interrupted webs 23 extending transversely of the longitudinal axis.

These transverse webs 23 give the sole a good rolling behaviour, while in addition, because of the distinct relief of the underside of the sole, the sole can be universally used even in winter or on a resilient subsoil.

Parallel to the sole outer contour or outside 25 and at a specific distance therefrom two longitudinal ribs 27 and 29 are provided, the distance between each longitudinal rib being distinctly less than half the sole width in the heel zone 9.

As will be seen from FIG. 2, the two longitudinal ribs 27 and 29 extend from the outer contour 25 along the tip 31 of the sole as far as the inside 13.

In the front end zone a zone 33 projecting in the form of a band is provided around the tip 31 of the sole 1 and a projecting zone 35 is likewise provided at the rear end of the sole 1. The height of the projecting elements 23, of the projecting longitudinal ribs 27 and 29, and of the projecting zones 33 and 35 is substantially the same.

In the intermediate section between the ball of the foot zone 11 and the heel zone 9 an edge zone 37 and 38 is provided both on the inside 13 and on the outside 25 and projects away from the underside towards the inside 3 of the sole so that these two edge zones do not usually touch the ground during walking.

In the exemplified embodiment of the sole 1 according to the invention as illustrated, the width of the edge zones 37 and 38 is about 10 to 20% of the total width of the sole in that zone.

An advertising zone 39 can also be provided on the underside 21 of the sole 1 and, for example, bear the sole and/or shoemaker's mark.

Figure 3:
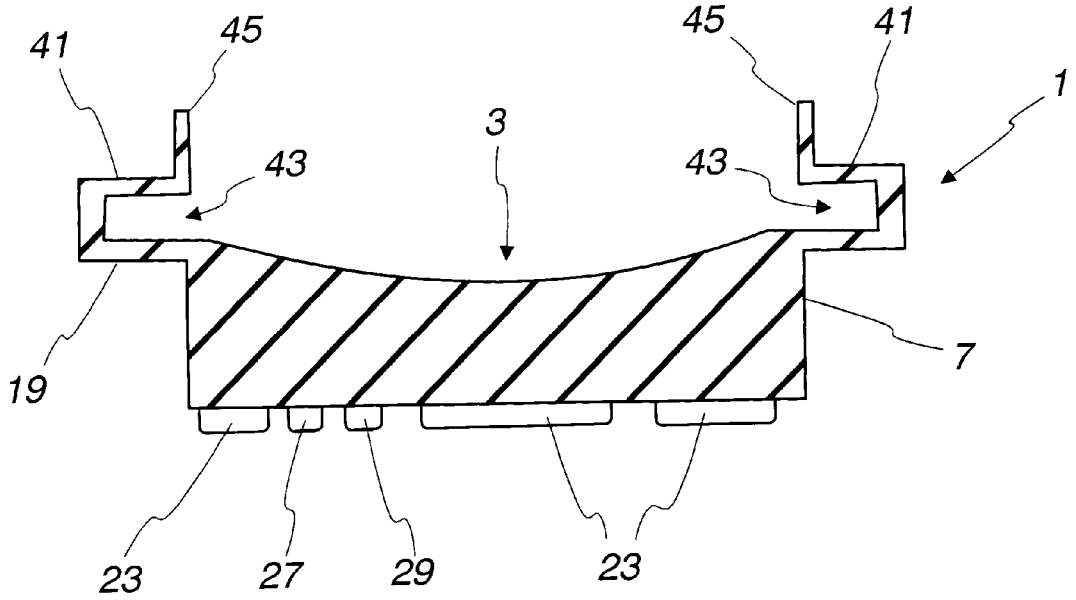
FIG. 3 is a section on the line III—III in FIG. 1.

FIG. 3 is a section on the line III—III in FIG. 1.

The longitudinal extending ribs 27, 29 and the transverse webs 23 will be clear on the underside of the sole 1. The inwardly projecting webs 7 extend with a downward curvature to adapt to the corresponding form of the human foot.

The edge zone 19, the projecting elements 7 and the elements on the underside 23, 27 and 29 are advantageously formed integrally with one another. A lateral bead 41 is formed on the outer wall, inside 13 and outside 25 of the sole 1 according to the invention and defines an inner fillet 43. The bead 41 is closed on the inside by an edge 45 in the form of a web which extends substantially vertically upwards and around the entire sole.

Figure 4:
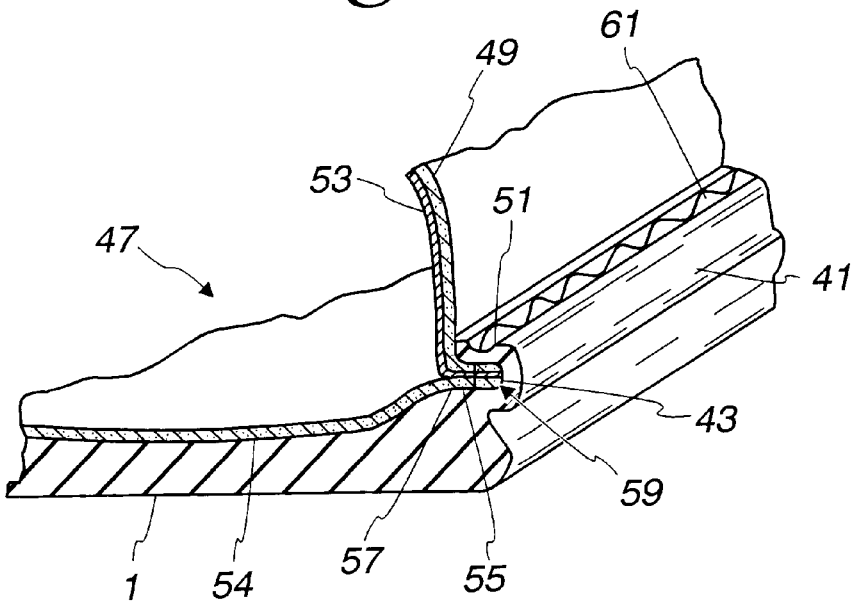
FIG. 4 is a detail of a shoe having the sole according to the invention and the connection between the upper and the insole in section.

FIG. 4 is a partial section of a shoe 47 having a sole 1 according to the invention.

The shoe 47 comprises an upper 49 which at its bottom edge 51 is bent outwards together with an inner lining 53 and is sewn to an edge 55 of an insole 54 by a seam 57. The edges are so sewn together as to form an outwardly projecting peripheral edge seam 59 which is disposed in the fillet 43 extending along the inside of the sole. The fillet 43 is defined by the bead 41 which, as will be clear from FIG. 3, is formed laterally on the outer wall of the sole 1 in the top zone. The bead 41 is combined with an outer seam 61 by means of which the upper 49 is connected to the insole 54 and to the outsole 1.

The components of the shoe 47, as will be seen from FIG. 4, are only sewn together, any gluing together of the components being avoided.

To summarise: the outsole 1 according to the invention provides a shoe component by means of which anatomically correct walking equivalent to barefoot walking is obtained practically completely.

Also, as described above, in conjunction with the other components of a shoe, a new shoe with the sole according to the invention is created in which the feeling of walking barefoot is embodied.

I claim:

1. An outsole for a shoe made of a flexible material, the outsole comprising:

a sole surface having an inner surface, an underside opposing the inner surface, a longitudinal axis, a heel zone at one end of the longitudinal axis, a toe zone at another end of the longitudinal axis, a ball of the foot zone between the toe and heel zones, and an edge surrounding the sole surface;

inner projecting elements on the inner surface wherein the inner projecting elements form a substantially rectangular grid;

outer projecting elements on the underside, wherein the outer projecting elements are interrupted webs that extend substantially transversely to the longitudinal axis;

at least one longitudinal rib on the underside wherein the longitudinal rib is parallel to the edge on the sole underside and has a distance from the edge less than half the outsole width in the heel zone; and a sickle-shaped reinforcement zone on the inner surface filling a portion of the rectangular grid between the ball of the foot zone and the heel zone and extending from the edge in the direction of the longitudinal axis of the sole.

2. The outsole according to claim 1 wherein the inner and outer projecting elements are made in one piece with the sole surface.

3. The outsole according to claim 1 wherein the longitudinal rib is made in one piece with the sole surface.

4. The outsole according to claim 1 wherein longitudinal rib in the toe zone of follows the edge of the sole surface at a substantially equal distance therefrom while extending along the inside of the shoe sole in that toe zone.

5. The outsole according to claim 1, further comprising a planar flat projecting element provided in the heel end zone on the underside and substantially follows the outer contour of the heel zone, while extending further forward at the outside of the sole surface than at the inside.

6. The outsole according claim 1 further comprising a band projecting element provided in a band at the toe zone on the underside of the sole surface and extending substantially along the edge of the toe zone and has at least one longitudinal rib extending around it in the toe zone.

7. The outsole according claim 1 further comprising a second longitudinal rib is extending parallel to and substantially over the entire length of the first longitudinal rib.

8. The outsole according claim 1, wherein the distance between the inner projecting elements extending parallel to the longitudinal axis of the is equivalent at least to the width of the projecting elements.

9. The outsole according claim 1 wherein in a region between the heel zone and the ball of the foot zone there is an edge zone offset from the edge in the direction of the inner surface and projecting beyond the inner surface of the sole surface.

10. The outsole according to claim 1 wherein the width of an edge zone is about 10 to 20% of the total width in this zone.

11. The outsole according claim 1 wherein the inner projecting elements in the form of a grid have a different height adapted to the form of the human foot sole.

12. An outsole for a shoe made of a flexible material wherein the shoe having an upper which is connected to an insole made of natural material and is fixed to the outsole, the upper having an outwardly projecting edge connected to the insole at an edge thereof, the outsole comprising:

a sole surface having an inner surface, an underside opposing the inner surface, a longitudinal axis, a heel zone at one end of the longitudinal axis, a toe zone at another end of the longitudinal axis, a ball of the foot zone between the toe and heel zones, and an edge surrounding the sole surface;

inner projecting elements on the inner surface wherein the inner projecting elements form a substantially rectangular grid;

outer projecting elements on the underside, wherein the outer projecting elements are interrupted webs that extend substantially transversely to the longitudinal axis;

at least one longitudinal rib on the underside wherein the longitudinal rib is parallel to the edge on the sole underside and has a distance from the edge less than half the sole width in the heel zone;

a sickle-shaped reinforcement zone on the inner surface filling a portion of the rectangular grid between the ball of the foot zone and the heel zone and extending from the edge in the direction of the longitudinal axis of the sole; and a lateral bead formed on an outer wall of the outsole, wherein the lateral bead forms a fillet and wherein the projecting edge of the upper fits is disposed in the fillet.

13. The outsole according to claim 12 wherein the inner and outer projecting elements are made in one piece with the sole surface.

14. The outsole according to claim 12 wherein the longitudinal rib is made in one piece with the sole surface.

15. The outsole according to claim 12 wherein longitudinal rib in the toe zone of follows the edge of the sole surface at a substantially equal distance therefrom while extending along the inside of the shoe sole in that toe zone.

16. The outsole according to claim 12 further comprising a planar flat projecting element provided in the heel end zone on the underside and substantially follows the outer contour of the heel zone, while extending further forward at the outside of the sole surface than at the inside.

17. The outsole according to claim 12 further comprising a band projecting element provided in a band at the toe zone on the underside of the sole surface and extending substantially along the edge of the toe zone and has at least one longitudinal rib extending around it in the toe zone.

18. The outsole according to claim 12 further comprising a second longitudinal rib is extending parallel to and substantially over the entire length of the first longitudinal rib.

19. The outsole according to claim 12 wherein the distance between the inner projecting elements extending parallel to the longitudinal axis of the is equivalent at least to the width of the projecting elements.

20. The outsole according to claim 12 wherein in a region between the heel zone and the ball of the foot zone there is an edge zone offset from the edge in the direction of the inner surface and projecting beyond the inner surface of the sole surface.

21. The outsole according to claim 12 wherein the width of an edge zone is about 10 to 20% of the total width in this zone.

22. The outsole according to claim 12 wherein the inner projecting elements in the form of a grid have a different height adapted to the form of the human foot sole.

23. The outsole according to claim 12 wherein the upper is secured to the outsole by means of an outer seam extending through the bead the projecting edges.

* * * * *